US007183980B2

(12) United States Patent
Chang et al.

(10) Patent No.: US 7,183,980 B2
(45) Date of Patent: Feb. 27, 2007

(54) INVERTED-F ANTENNA

(75) Inventors: Ping-Cheng Chang, Taipei (TW); Wen-Fa Lin, Taipei (TW); Tsung-Wen Chiu, Taipei (TW); Fu-Ren Hsiao, Taipei (TW)

(73) Assignee: Advanced Connectek, Inc., Taipei (TW)

( * ) Notice: Subject to any disclaimer, the term of this patent is extended or adjusted under 35 U.S.C. 154(b) by 0 days.

(21) Appl. No.: 11/211,539

(22) Filed: Aug. 26, 2005

(65) Prior Publication Data

US 2006/0187121 A1 Aug. 24, 2006

(51) Int. Cl.
*H01Q 1/24* (2006.01)
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,448,932 B1 * 9/2002 Stoiljkovic et al. .. 343/700 MS
6,657,593 B2 * 12/2003 Nagumo et al. ..... 343/700 MS
6,727,854 B2 4/2004 Fang et al. ..... 343/700 MS
7,113,133 B2 * 9/2006 Chen et al. ..... 343/700 MS
2003/0122722 A1 * 7/2003 Sugiyama et al. ..... 343/767
2004/0085245 A1 * 5/2004 Miyata et al. ..... 343/700 MS

* cited by examiner

*Primary Examiner*—Tan Ho
(74) *Attorney, Agent, or Firm*—Troxell Law Office, PLLC

(57) ABSTRACT

An inverted-F antenna comprises a microwave plate, a dielectric substrate, a radiating metal sheet, a ground surface, a shorting metal strip, and a feeding metal strip. The radiating metal sheet comprises a connecting metal sheet, first, second, and third child radiating metal sheets, a matching metal sheet, a slot, a shorting point, and a feeding point. The first child radiating metal sheet is for forming a low frequency operating mode. The second child radiating metal sheet is for forming a high frequency operating mode. The third child radiating metal sheet is for adjusting operating frequency and bandwidth of the second operating mode. The slot, the shorting point, and the feeding point are for adjusting impedance matching. The grounding surface is for increasing the operating bandwidth of the low frequency operating mode. The shorting metal sheet and the feeding metal sheet are for grounding the antenna and signal transmission.

10 Claims, 2 Drawing Sheets

INVERTED-F ANTENNA

BACKGROUND OF THE INVENTION

1. Field of the Invention

The present invention relates generally to an antenna, especially to an inverted-F antenna applied in wireless communication products.

2. Description of Related Art

In recent years, wireless communication has known a rapid, spectacular development. Also, requirements for quality and performance of antenna mounted in a wireless communication device (e.g., cellular phone, PDA) are increased. In addition to the requirement of miniature antenna, multiple frequency band or ultra-wideband feature is also necessary for keeping up with the trend. Moreover, for aesthetic and practical purposes a miniature antenna is typically mounted within a wireless communication device (e.g., cellular phone). However, construction of the antenna can be very complicated for meeting the above requirements and needs. Thus, it is important to further improve the prior hidden antenna by fully taking advantage of the limited space in a wireless communication device (e.g., cellular phone or PDA).

Typically, a wireless communication device (e.g., cellular phone or PDA) is equipped with an inverted-F antenna therein. For example, U.S. Pat. No. 6,727,854 discloses a planar inverted-F antenna mounted in a cellular phone in FIG. 1. The antenna comprises a radiating device including left and right radiating elements (e.g., metallic strips) and an intermediate radiating elements (e.g., metallic patch) in which a feeding point 15 is formed at one end of the left radiating element, a shorting point 16 is formed at one end of the right radiating element opposing the feeding point 15, and three surface current pathways 10, 13, and 14 are formed in the intermediate, left, and right radiating elements respectively. Two different resonance frequencies are generated by these surface current pathways such that the antenna is able to operate in a GSM band or DCS band (i.e., dual-band capability).

However, the prior art suffered from several disadvantages. For example, only a single shorting line is provided. Further, its construction is relatively complicated. Furthermore, the surface current pathways are meandered, resulting in a narrowing of bandwidth (i.e., only suitable for dual-band applications). Moreover, its adjustment is difficult in practice. Thus, the need for improvement still exists in order to overcome the inadequacies of the prior art.

SUMMARY OF THE INVENTION

The object of the present invention is to provide an innovative design of an inverted-F antenna, which could increase the bandwidth and efficiency of the antenna to meet the bandwidth requirements of the system frequency band.

The inverted-F antenna of the present invention comprises a microwave plate, a dielectric substrate, a radiating metal sheet, a ground surface, a shorting metal strip and a feeding metal strip. The microwave plate has a first surface and a second surface. The dielectric substrate located on the upper side of the first surface of the microwave plate has an upper surface, two first lateral sides, and two second lateral sides. Thereinto, the outer first lateral side is adjacent to and generally parallel to the short edge of the microwave plate; the second lateral side is perpendicular to the first lateral side. The length of the first lateral side is longer than that of the second lateral side. The radiating metal sheet comprises a connecting metal sheet, a first child radiating metal sheet, a second child radiating metal sheet, a third child radiating metal sheet, a matching metal sheet, a slot, a shorting point and a feeding point. Thereinto, the connecting metal sheet is located on the upper surface of the dielectric substrate and adjacent to the second lateral side. The first child radiating metal sheet is located on the first lateral side of the dielectric substrate. One end of which is connected with the connecting metal sheet and the other end extends along the direction far away from the second lateral side. The first child radiating metal sheet has a long current path for forming the first (low frequency) operating mode of the antenna by revising the length and width of the first child radiating metal sheet. It could fine to adjust the central frequency of the first (low frequency) operating mode. The second child radiating metal sheet located on the upper surface of the dielectric substrate and connected with the connecting metal sheet at one end has a shorter current path for forming the second (high frequency) operating mode of the antenna. Similarly, revising its length could also fine to adjust the central frequency of the second (high frequency) operating mode. The third child radiating metal sheet is located on the upper surface of the dielectric substrate. One end of which is connected with the first child radiating metal sheet and the other end is adjacent to the second child radiating metal sheet by use of the electrical capacity effect existed therebetween. It could adjust the operating frequency and the operating bandwidth of the second operating mode of the antenna by changing the length and the width of the third child radiating metal sheet. It could fine to adjust the capacitance capacitive reactance value thereof. The matching metal sheet is located on the upper surface of the dielectric substrate and is connected with the connecting metal sheet. The slot, the shorting point and the feeding point are located on the matching metal sheet. Thereinto, the opening end of the slot is located on one edge of the matching metal sheet and between the shorting point and the feeding point, and the other end extends toward the inside of the matching metal sheet. The length of the slot could effectively change the path length between the shorting point and the feeding point. Therefore it could be used for adjusting the impedance matching of the antenna mode by changing the distance between the shorting point and the feeding point as well as the length of the slot appropriately. It could make the antenna to achieve a perfect impedance matching. The grounding surface is located on the first surface of the microwave plate and has a gap portion located on the lower side of the first child radiating metal sheet. The shorting metal strip has one end connected to the ground surface and the other end connected with the shorting point of the radiating metal sheet. The feeding metal strip has one end connected with the feeding point of the radiating metal sheet and the other end connected to the system signal source for signal transmission.

In the present design, the first child radiating metal sheet is located on the first lateral side of the dielectric substrate, i.e. it is on the remotest position from the system ground surface. Therefore, it could have a lowest capacitance rate between the radiating metal sheet and the system ground surface. The energy has a better radiating effect. The system ground surface uses a gap mode, which could decrease the capacitance rate between the radiating metal sheet and the system ground surface similarly. It improves the bandwidth and efficiency of the antenna in large scale. Therefore it could achieve a broader band antenna by adjusting the gap portion of the ground surface properly. It could achieve a dual frequency antenna to fit the system bandwidth requirements.

DETAILED DESCRIPTION OF THE PREFERRED EMBODIMENTS

Figure 1:
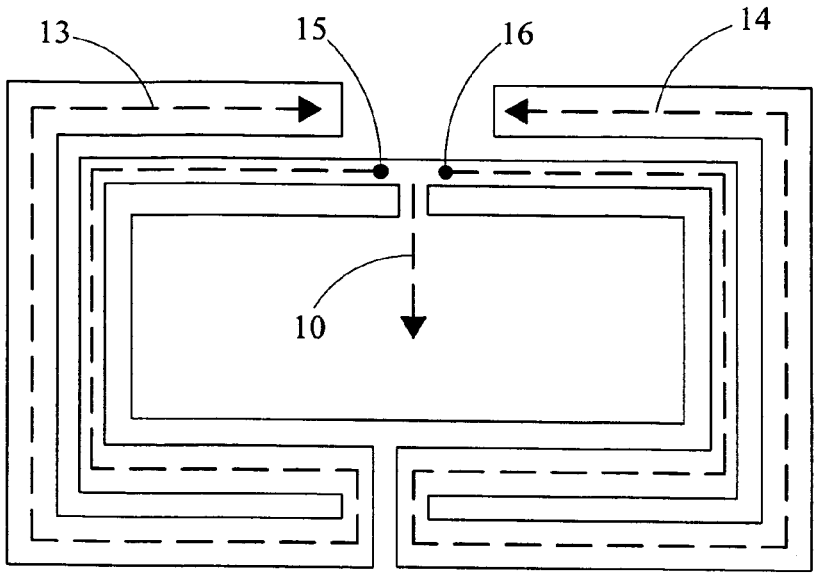
FIG. 1(PRIOR ART)
FIG. 1 is an illustrative plan view of a conventional inverted-F antenna.
Figure 2:
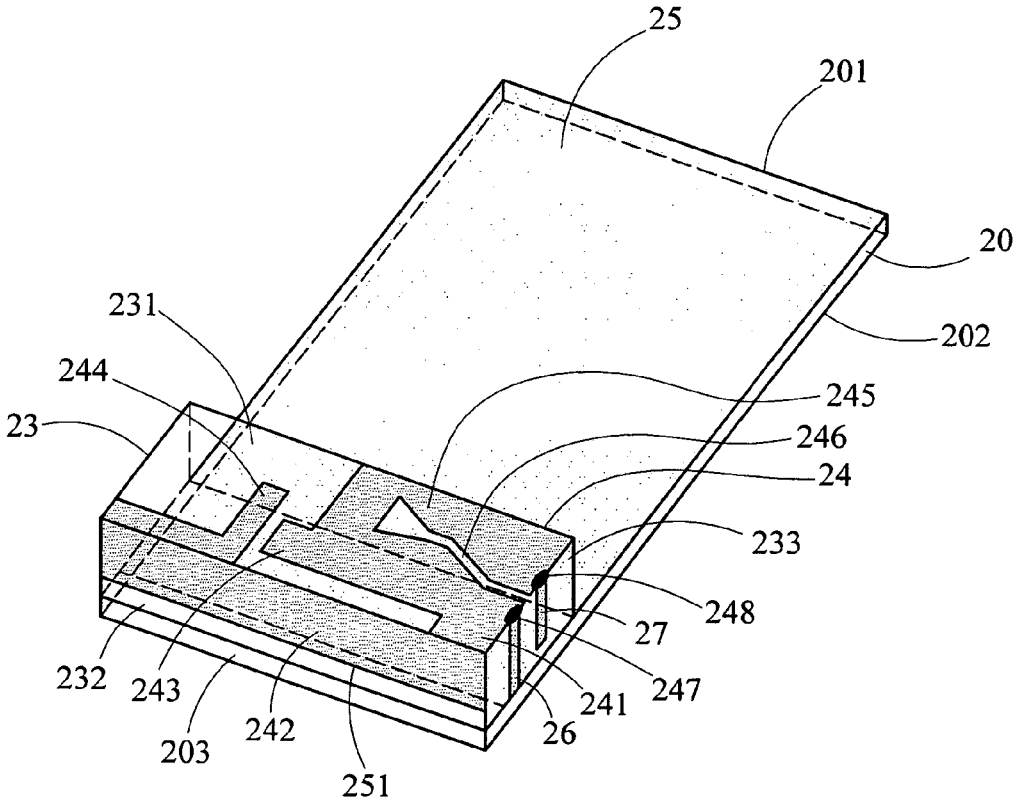
FIG. 2 is a perspective view of a first embodiment of the inverted-F antenna of the present invention.

As shown in FIG. 2, an inverted-F antenna of a first embodiment of the present invention comprises a microwave plate 20, a dielectric substrate 23, a radiating metal sheet 24, a ground surface 25, a shorting metal strip 26 and a feeding metal strip 27.

The microwave plate 20 has a first surface 201 and a second surface 202.

The dielectric substrate 23 located on the upper side of the first surface 201 of the microwave plate 20 has an upper surface 231, two first lateral sides 232 and two second lateral sides 233. In practice, the dielectric substrate 23 could be air or a plastic material of which the dielectric constant is about 1. Thereinto, the outer first lateral side 232 is adjacent to and generally parallel to the short edge 203 of the microwave plate 20. The second lateral side 233 is perpendicular to the first lateral side 232. The length of the first lateral side 232 is longer than that of the second lateral side 233.

The radiating metal sheet 24 comprises a connecting metal sheet 241, a first child radiating metal sheet 242, a second child radiating metal sheet 243, a third child radiating metal sheet 244, a matching metal sheet 245, a slot 246, a shorting point 247 and a feeding point 248. Thereinto, the connecting metal sheet 241 is located on the upper surface 231 of the dielectric substrate 23 and adjacent to the second lateral side 233. The first child radiating metal sheet 242 is located on the first lateral side 232 of the dielectric substrate 23, one end of which is connected with the connecting metal sheet 241, and the other end extends along the direction far away from the second lateral side 233. The first child radiating metal sheet 242 has a long current path for forming the first (low frequency) operating mode of the antenna by revising the length and the width of the first child radiating metal sheet 242. It could fine to adjust the central frequency of the first (low frequency) operating mode to meet the system needed frequency band requirements. The second child radiating metal sheet 243, located on the upper surface 231 of the dielectric substrate 23 and connected with the connecting metal sheet 241 at one end, has a shorter current path for forming the second (high frequency) operating mode of the antenna. Similarly, revising its length could also fine to adjust the central frequency of the second (high frequency) operating mode. The third child radiating metal sheet 244 is located on the upper surface 231 of the dielectric substrate 23, one end of which is connected with the first child radiating metal sheet 242 and the other end is adjacent to the second child radiating metal sheet 243 by use of the electrical capacity effect existed there-between. It could adjust the operating frequency and the operating bandwidth of the second operating mode of the antenna by changing the length and the width of the third child radiating metal sheet 244. It could fine to adjust the capacitance capacitive reactance value thereof. The matching metal sheet 245 is located on the upper surface 231 of the dielectric substrate 23 and is connected with the connecting metal sheet 241. The slot 246, the shorting point 247 and the feeding point 248 are located on the matching metal sheet 245. Thereinto, the opening end of the slot 246 is located on an edge of the matching metal sheet 245 and between the shorting point 247 and the feeding point 248, and the other end extends toward the inside of the matching metal sheet 245. The length of the slot 246 could effectively change the path length between the shorting point 247 and the feeding point 248 Therefore it could be used for adjusting the impedance matching of the antenna mode by changing the distance between the shorting point 247 and the feeding point 248 as well as the length of the slot 246 appropriately. It could make the antenna to achieve a perfect impedance matching.

The grounding surface 25 is located on the first surface 201 of the microwave plate 20 and has a gap portion 251, which is located on the lower side of the first child radiating metal sheet 242 and adjacent to the short edge 203 of the microwave plate 20. The gap portion 251 could make the first radiating metal sheet 242 to be further away from the system ground surface 25 and to make the operating bandwidth of the first (low frequency) operating mode of the antenna to increase in large scale.

The shorting metal strip 26 has one end connected to the ground surface 25 and the other end connected with the shorting point 247 of the radiating metal sheet 24.

The feeding metal strip 27 has one end connected with the feeding point 248 of the radiating metal sheet 24 and the other end connected to the system signal source for signal transmission.

Figure 3:
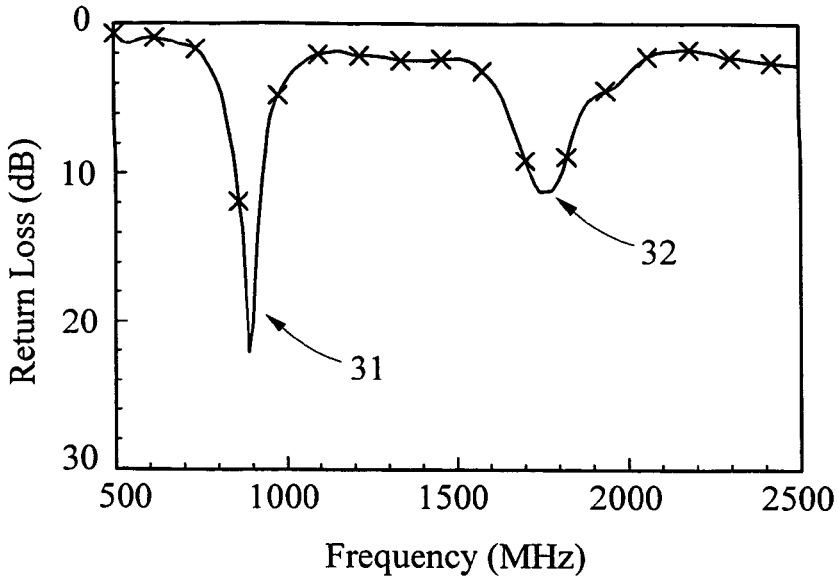
FIG. 3 is the experiment result of the return loss of the first embodiment of the inverted-F antenna of the present invention.

FIG. 3 shows the experiment result of the return loss of the antenna of the first embodiment of the present invention. The curve line 31 is the first (low frequency) operating mode of the antenna, and the curve line 32 is the second (high frequency) operating mode of the antenna. From the experiment result, it could see the impedance bandwidth of the two operating modes of the embodiment defined to be 2.5:1 of the VSWR (voltage standing wave ratio). It could reach to 110 MHz and 170 MHz and could meet the frequency band requirement of the mobile phone system GSM band (880~960 MHz) and DCS band (1710~1880 MHz).

Figure 4:
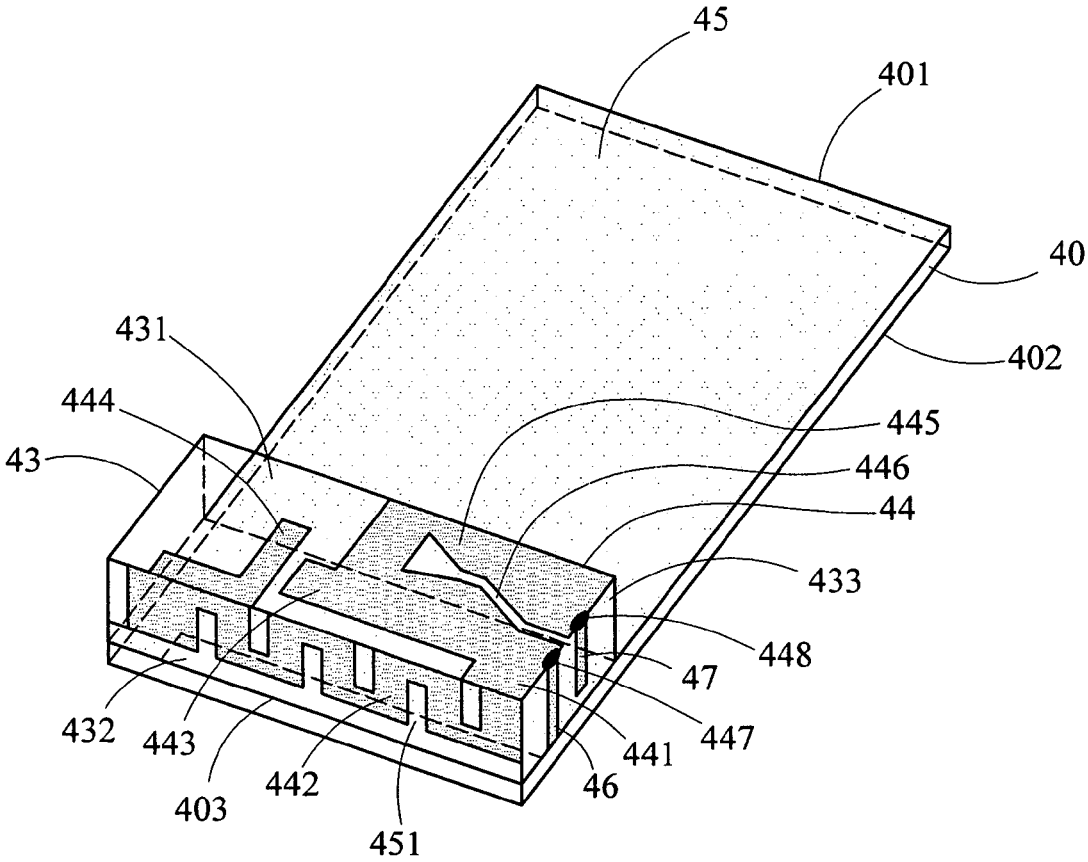
FIG. 4 is a perspective view of a second embodiment of the inverted-F antenna of the present invention.

As shown in FIG. 4, an inverted-F antenna of a second embodiment of the present invention comprises a microwave plate 40, a dielectric substrate 43, a radiating metal sheet 44, a ground surface 45, a shorting metal strip 46 and a feeding metal strip 47.

The microwave plate 40 has a first surface 401 and a second surface 402.

The dielectric substrate 43 located on the upper side of the first surface 401 of the microwave plate 40 has an upper surface 431, two first lateral sides 432, and two second lateral sides 433. The dielectric substrate 43 could be air or a plastic material of which the dielectric constant is about 1. Thereinto, the outer first lateral side 432 is adjacent to and generally parallel to the short edge 403 of the microwave plate 40. The second lateral side 433 is perpendicular to the first lateral side 432. The length of the first lateral side 432 is longer than that of the second lateral side 433.

The radiating metal sheet 44 comprises a connecting metal sheet 441, a first child radiating metal sheet 442, a second child radiating metal sheet 443, a third child radiating metal sheet 444, a matching metal sheet 445, a slot 446, a shorting point 447 and a feeding point 448. Thereinto, the connecting metal sheet 441 is located on the upper surface 431 of the dielectric substrate 43 and adjacent to the second lateral side 433. The first child radiating metal sheet 442 is located on the first lateral side 432 of the dielectric substrate 43, one end of which is connected with the connecting metal sheet 441, and the other end extends in zigzag mode along the direction far away from the second lateral side 433. The first child radiating metal sheet 442 has a long current path for forming the first (low frequency) operating mode of the antenna by revising the whole zigzag length and the zigzag width of the first child radiating metal sheet 442. It could fine to adjust the central frequency of the first (low frequency) operating mode to meet the system needed frequency band requirements. The second child radiating metal sheet 443 located on the upper surface 431 of the dielectric substrate 43 and connected with the connecting metal sheet 441 at one end. It has a shorter current path for forming the second (high frequency) operating mode of the antenna. Similarly, revising its length could also fine to adjust the central frequency of the second (high frequency) operating mode. The third child radiating metal sheet 444 is located on the upper surface 431 of the dielectric substrate 43, one end of which is connected with the first child radiating metal sheet 442 and the other end is adjacent to the second child radiating metal sheet 443 by use of the electrical capacity effect existed there-between. It could adjust the operating frequency and the operating bandwidth of the second operating mode of the antenna by changing the length and the width of the third child radiating metal sheet 444. It could fine to adjust the capacitance capacitive reactance value thereof. The matching metal sheet 445 is located on the upper surface 431 of the dielectric substrate 43 and is connected with the connecting metal sheet 441. The slot 446, the shorting point 447 and the feeding point 448 are located on the matching metal sheet 445. Thereinto, the opening end of the slot 446 is located on one edge of the matching metal sheet 445 and between the shorting point 447 and the feeding point 448, and the other end extends toward the inside of the matching metal sheet 445. The length of the slot 446 could effectively change the path length between the shorting point 447 and the feeding point 448. Therefore it could be used for adjusting the impedance matching of the antenna mode by changing the distance between the shorting point 447 and the feeding point 448 as well as the length of the slot 446 appropriately. It could make the antenna to achieve a perfect impedance matching.

The grounding surface 45 is located on the first surface 401 of the microwave plate 40 and has a gap portion 451, which is located on the lower side of the first child radiating metal sheet 442 and adjacent to the short edge 403 of the microwave plate 40. The gap portion 451 could make the first radiating metal sheet 442 to be further away from the system ground surface 45 and to make the operating bandwidth of the first (low frequency) operating mode of the antenna to increase in large scale.

The shorting metal strip 46 has one end connected to the ground surface 45 and the other end connected with the shorting point 447 of the radiating metal sheet 44.

The feeding metal strip 47 has one end connected with the feeding point 448 of the radiating metal sheet 44 and the other end connected to the system signal source for signal transmission.

The embodiments disclosed in the present invention are only illustrative and not limitative to the scope of the present invention. Therefore, any changes or modifications made by those skilled in the art via the description of the present invention without departing from the spirit of the invention are considered as like structures and covered by the claims of the present invention.

What is claimed is:

1. An inverted-F antenna, comprising:

a microwave plate;

a dielectric substrate;

a radiating metal sheet;

a ground surface;

a shorting metal strip; and a feeding metal strip;

wherein said microwave plate has a first surface and a second surface; said dielectric substrate located on an upper side of the first surface of said microwave plate, has an upper surface, two first lateral sides and two second lateral sides, thereinto, an outer edge of the first lateral side adjacent to and generally parallel to a short edge of said microwave plate, said second lateral side perpendicular to said first lateral side, and the length of said first lateral side is longer than that of said second lateral side;

said radiating metal sheet comprises a connecting metal sheet, a first child radiating metal sheet, a second child radiating metal sheet, a third child radiating metal sheet, a matching metal sheet, a slot, a shorting point and a feeding point, thereinto, said connecting metal sheet located on the upper surface of said dielectric substrate and adjacent to said second lateral side, said first child radiating metal sheet located on said first lateral side of said dielectric substrate, one end of which is connected to said connecting metal sheet and the other end of which is extending along a direction far away from said second lateral side, said first child radiating metal sheet having a long current path for forming a first low frequency operating mode of said antenna, said second child radiating metal sheet located on the upper surface of said dielectric substrate and connected to said connecting metal sheet at one end having a shorter current path for forming a second high frequency operating mode of said antenna, said third child radiating metal sheet located on the upper surface of said dielectric substrate, one end of which is connected with said first child radiating metal sheet and the other end of which is adjacent to said second child radiating metal sheet, an existed electrical capacity effect being for adjusting the operating frequency and an operating bandwidth of said second operating mode of said antenna, said matching metal sheet located on the upper surface of said dielectric substrate and connected with said connecting metal sheet, said slot, said shorting point and said feeding point located on said matching metal sheet, and thereinto, an opening end of said slot located on an edge of said matching metal sheet and between said shorting point and said feeding point, and the other end extended toward an inside of said matching metal sheet;

said grounding surface located on said first surface of said microwave plate has a gap portion located on the lower side of said first child radiating metal sheet for increasing operating bandwidth of the first low frequency operating mode of said antenna;

said shorting metal strip has one end connected to said ground surface and the other end connected with the shorting point of the radiating metal sheet; and said feeding metal strip has one end connected with said feeding point of said radiating metal sheet and the other end connected to a system signal source for signal transmission.

2. The inverted-F antenna as claimed in claim 1, wherein said first child radiating metal sheet extends generally in a straight line.

3. The inverted-F antenna as claimed in claim 1, wherein said first child radiating metal sheet extends in zigzag mode.

4. The inverted-F antenna as claimed in claim 1, wherein the gap portion of said ground surface includes the whole of said first child radiating metal sheet.

5. The inverted-F antenna as claimed in claim 1, wherein the gap portion of said ground surface includes a part of said first child radiating metal sheet.

6. The inverted-F antenna as claimed in claim 1, wherein said dielectric substrate is air or a plastic material of which the dielectric constant is about 1.

7. An inverted-F antenna comprising:

a microwave plate;

a dielectric substrate;

a radiating metal sheet;

a ground surface;

a shorting metal strip; and a feeding metal strip;

wherein said microwave plate has a first surface and a second surface; said dielectric substrate located on the upper side of the first surface of said microwave plate has an upper surface, two first lateral sides and two second lateral sides;

said radiating metal sheet comprises a connecting metal sheet, a first child radiating metal sheet, a second child radiating metal sheet, a third child radiating metal sheet, a matching metal sheet, a slot, a shorting point and a feeding point;

said grounding surface located on said first surface of said microwave plate has a gap portion;

said shorting metal strip has one end connected to said ground surface and the other end connected with said shorting point of the radiating metal sheet; and said feeding metal strip has one end connected with said feeding point of said radiating metal sheet and the other end connected to a system signal source for signal transmission.

8. The inverted-F antenna as claimed in claim 7, wherein the dielectric substrate is located on an outer first lateral side and adjacent to and generally parallel to a short edge of the microwave plate, the second lateral side perpendicular to a first lateral side, and a length of the first lateral side being longer than that of the second lateral side.

9. The inverted-F antenna as claimed in claim 7, wherein said connecting metal sheet is located on an upper surface of said dielectric substrate and adjacent to said second lateral side, said first child radiating metal sheet located on said first lateral side of said dielectric substrate, one end of which is connected with said connecting metal sheet and the other end of which is extended along the direction far away from said second lateral side, said first child radiating metal sheet having a long current path for forming a first low frequency operating mode of said antenna, said second child radiating metal sheet located on the upper surface of said dielectric substrate and connected with said connecting metal sheet at one end having a shorter current path for forming a second high frequency operating mode of said antenna, said third child radiating metal sheet located on the upper surface of said dielectric substrate, one end of which is connected with said first child radiating metal sheet and the other end of which is adjacent to said second child radiating metal sheet, the existed electrical capacity effect being for adjusting a operating frequency and a operating bandwidth of said second operating mode of said antenna, said matching metal sheet located on the upper surface of said dielectric substrate and connected with said connecting metal sheet, said slot, said shorting point and said feeding point located on said matching metal sheet, and thereinto, an opening end of said slot located on an edge of said matching metal sheet and between said shorting point and said feeding point, and the other end extended toward the inside of said matching metal sheet.

10. The inverted-F antenna as claimed in claim 7, wherein said gap portion is located on a lower side of said first child radiating metal sheet and adjacent to the short edge of the microwave plate for increasing an operating bandwidth of a first low frequency operating mode of said antenna.

* * * * *